US008522685B1

(12) United States Patent
Gold et al.

(10) Patent No.: US 8,522,685 B1
(45) **Date of Patent: *Sep. 3, 2013**

(54) MULTIPLE SIZE FRAGMENT WARHEAD

(75) Inventors: Vladimir M. Gold, Hillside, NJ (US); Jeffrey R. Kraft, Newton, NJ (US); Ernest L. Baker, Wantage, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 2 days.

This patent is subject to a terminal disclaimer.

(21) Appl. No.: 13/215,510

(22) Filed: Aug. 23, 2011

Related U.S. Application Data

(63) Continuation-in-part of application No. 12/709,534, filed on Feb. 22, 2010, now Pat. No. 8,272,330.

(51) Int. Cl.
*F42B 12/22* (2006.01)
*F42B 12/28* (2006.01)

(52) U.S. Cl.
USPC ..... 102/494; 102/492; 102/475

(58) Field of Classification Search
USPC ..... 102/389, 475, 491, 492, 493, 494, 102/495, 506
See application file for complete search history.

(56) References Cited

U.S. PATENT DOCUMENTS

| | | | | | |
|---|---|---|---|---|---|
| 3,000,309 | A * | 9/1961 | Zapf | ..... | 102/493 |
| 3,491,694 | A * | 1/1970 | Fountain | ..... | 102/493 |
| 3,820,464 | A * | 6/1974 | Dixon | ..... | 102/493 |
| 4,305,333 | A * | 12/1981 | Altenau et al. | ..... | 102/306 |
| 4,312,274 | A * | 1/1982 | Zernow | ..... | 102/493 |
| 4,986,188 | A * | 1/1991 | Denis et al. | ..... | 102/493 |
| 5,131,329 | A * | 7/1992 | Lips et al. | ..... | 102/364 |
| 5,166,471 | A * | 11/1992 | Maselli et al. | ..... | 102/496 |
| 5,337,673 | A * | 8/1994 | Koontz et al. | ..... | 102/491 |
| 6,817,299 | B1 * | 11/2004 | Cooke | ..... | 102/493 |
| 6,857,372 | B2 * | 2/2005 | Renaud-Bezot et al. | ..... | 102/493 |
| 7,886,667 | B1 * | 2/2011 | Baker et al. | ..... | 102/495 |
| 8,272,329 | B1 * | 9/2012 | Hsieh et al. | ..... | 102/491 |
| 8,272,330 | B1 * | 9/2012 | Gold et al. | ..... | 102/494 |
| 8,276,520 | B1 * | 10/2012 | Fong et al. | ..... | 102/493 |

* cited by examiner

*Primary Examiner* — James Bergin
(74) *Attorney, Agent, or Firm* — Michael C. Sachs

(57) ABSTRACT

A fragmentation warhead includes a cylindrical fragmenting body, a pair of concentric cylindrical liners within, made of plastic, and an explosive charge disposed within the innermost liner. In one embodiment, one liner provides various "legs" of liner material and the other liner provides various open receptacle areas, into which such legs may come to rest when the liners are slid together and/or rotated relative to one another. Various recessed and/or raised areas of liner material can thus be randomly created by such adjustments, which lead to select fragmentation of the warhead upon detonation.

2 Claims, 12 Drawing Sheets

MULTIPLE SIZE FRAGMENT WARHEAD

RELATION TO OTHER APPLICATIONS

This application is a Continuation-in-Part of U.S. patent application Ser. No. 12/709,534 filed on Feb. 22, 2010 now U.S. Pat. No. 8,272,330 by the like inventors, and is commonly assigned.

U.S. GOVERNMENT INTEREST

The inventions described herein may be made, used, or licensed by or for the U.S. Government for U.S. Government purposes.

BACKGROUND OF INVENTION

Warhead fragmentation effectiveness is determined by the number, mass, shape, and velocity of the fragments. By using a controlled fragmentation design, warhead fragmentation can generally be achieved quickly and cost effectively. Exemplary controlled fragmentation techniques are described in U.S. Pat. Nos. 3,491,694; 4,312,274; 4,745,864; 5,131,329; and 5,337,673.

In general, conventional designs use "cutter" liners that form fragments by generating a complex pattern of high-velocity "penetrators" for fragmenting the shell. Although these conventional fragmentation designs have proven to be useful, it would be desirable to present additional functional, cost and safety improvements that minimize the warhead weight, reduce manufacture expenses, and advance current United States Insensitive Munition (IM) requirements.

What is therefore needed is a controlled fragmentation technique through the use of patterned liners which introduce shear stress into the warhead body and creates the desired fragmentation patterns. Fragment size, fragment numbers, and patterns thereof may be influenced through novel liner configurations. The need for such a controlled fragmentation technique has heretofore remained unsatisfied.

SUMMARY OF INVENTION

The present invention satisfies these needs, and presents a munition or warhead such as a projectile, and an associated method for generating controlled fragmentation patterns. According to the present invention, warhead fragmentation is achieved more efficiently and more cost effectively than conventional techniques, through the use of a relatively inexpensively formed plastic liner with a predetermined pattern of recessed areas and a plastic liner with a predetermined pattern of raised areas, sized to fit within the recessed areas, and capable of being moved about relatively and locked that way before detonation, to create varying levels of overall liner thickness in select regions, that is experienced during a detonation. The more thin regions will more likely lead to larger fragments ultimately, than will the more thick regions, as will be appreciated from the discussion here after. The liners could also be made of steel, tungsten, tantalum, or other materials.

According to one embodiment of the present invention, the warhead includes two movable liners that are disposed inside the warhead body which include predetermined patterns that are created with areas of different overall thicknesses presented to the exploding core, such allowing the detonation shock wave to correspondingly propagate into the fragmenting case through various effective thicknesses of liner material. The liner recessed and raised areas, and combinations thereof by physical positioning can, by varying thicknesses in regions, create contours of localized transitional regions with high-gradients of pressures, velocities, strains, and strain-rates acting as stress and strain concentration factors. Unstable thermoplastic shear (adiabatic shear) eventually transfers the entire burden of localized strain, to a finite number of shear planes leading to ultimately to an outer shell break-up and formation of fragments.

As a result, the explosion produces a complex pattern of shear planes in the warhead body, causing the case break-up and formation of fragments with various, predetermined sizes. This design is distinguishable from existing fragmentation liner technologies that attempt to score or cut the warhead body.

One of the advantages of the present embodiment compared to existing technologies is the cost effectiveness of the manufacturing process of the present design, in that it is faster and more economical to fabricate and to pattern plastic liners as opposed to notching or cutting a steel warhead body itself. Another advantage of the present invention is that the use of plastic material reduces the overall weight of the warhead compared with use of other materials. Fortuitously, the use of plastic is also a great safety feature. An unwanted ignition of the explosive due to the heat of launch would normally be catastrophic as well as fratricidal, but here the plastic liners in this invention are mounted to cover the explosive inside the casing body. In the event of unwanted heat/ignition, the plastic (which is also low melt temperature material), would melt to seal the explosive which adds to safety. Moreover the (melted) plastic would also flow and could push out overflows that are usually provided in these rounds. Because of the plastic, neither sudden pressure nor heat/ignition inside the round would therefore be as catastrophic. Therefore, choice of low-melt temperature plastic as liner materials in this invention, adds safety to the round. This benefit is favorable, consistent with current Insensitive Munition (IM) requirements in minimizing accidental ammunition explosion due to fire hazards.

OBJECTS OF THE INVENTION

It is an object of the present invention to provide means for generating fragments upon detonation of a warhead, with a relatively less expensive to manufacture structure of plastic liner components, and;

It is a further object of the present invention to provide a fragmentation warhead which generates fragments upon detonation wherein the size and shape of such fragments may be selected through liner design, and;

It is a still further object of the present invention to provide a fragmentation warhead which generates fragments upon detonation wherein the size and shape of such fragments may be selected prior to detonation by manually dialing in a change to positioning of liner components within said warhead, and;

It is a yet another object of the present invention to provide a fragmentation warhead of increased safety and sensitivity against unwanted fratricide of other warheads by reason of melting properties of the plastic materials within the warhead providing protection there against.

These and other objects, features and advantages of the invention will become more apparent in view of the within detailed descriptions of the invention and in light of the following drawings, in which:

DETAILED DESCRIPTION

Figure 1:
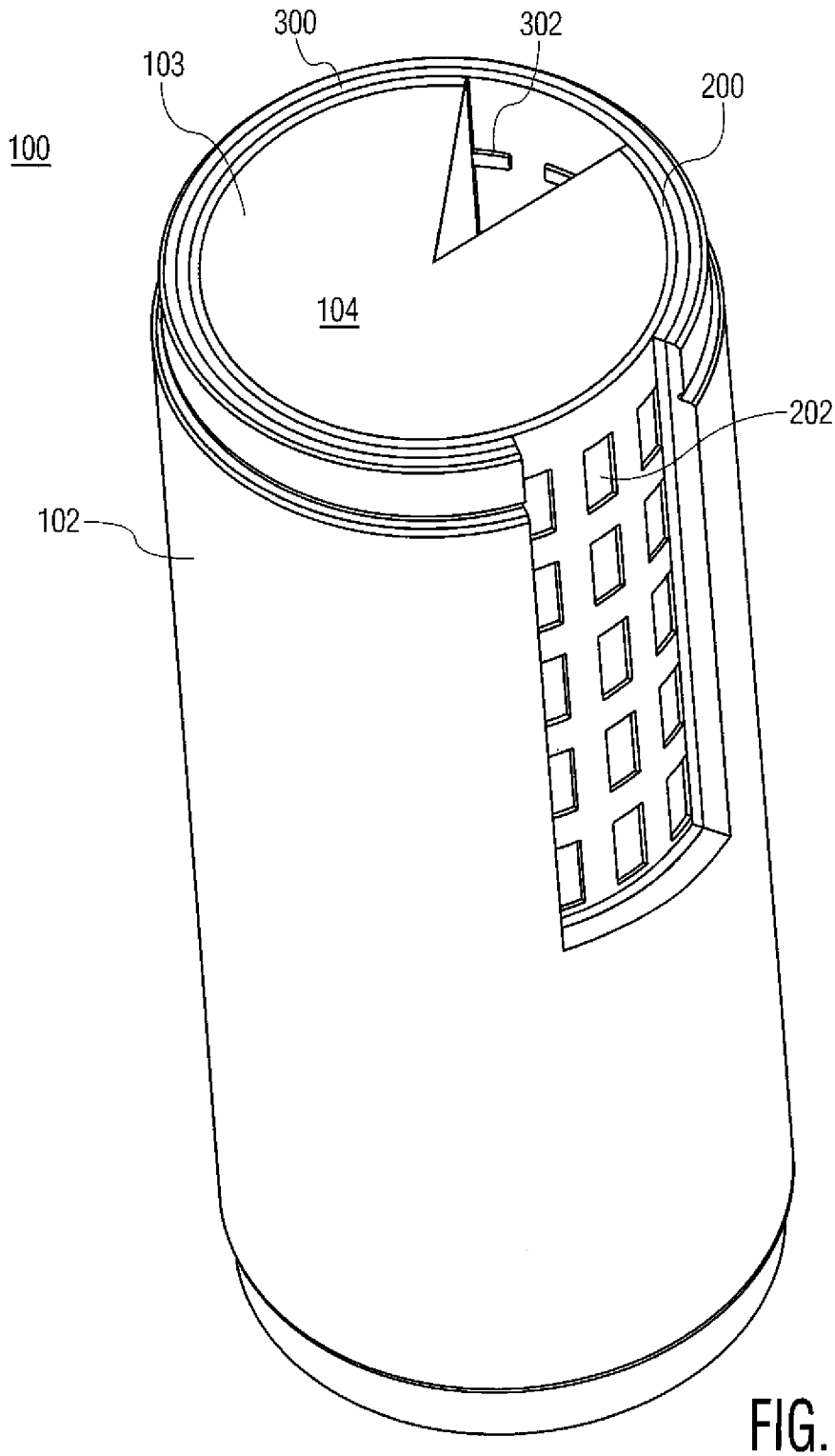
FIG. 1 shows a cutaway isometric view of a fragmenting warhead assembly according to this invention.
Figure 2:
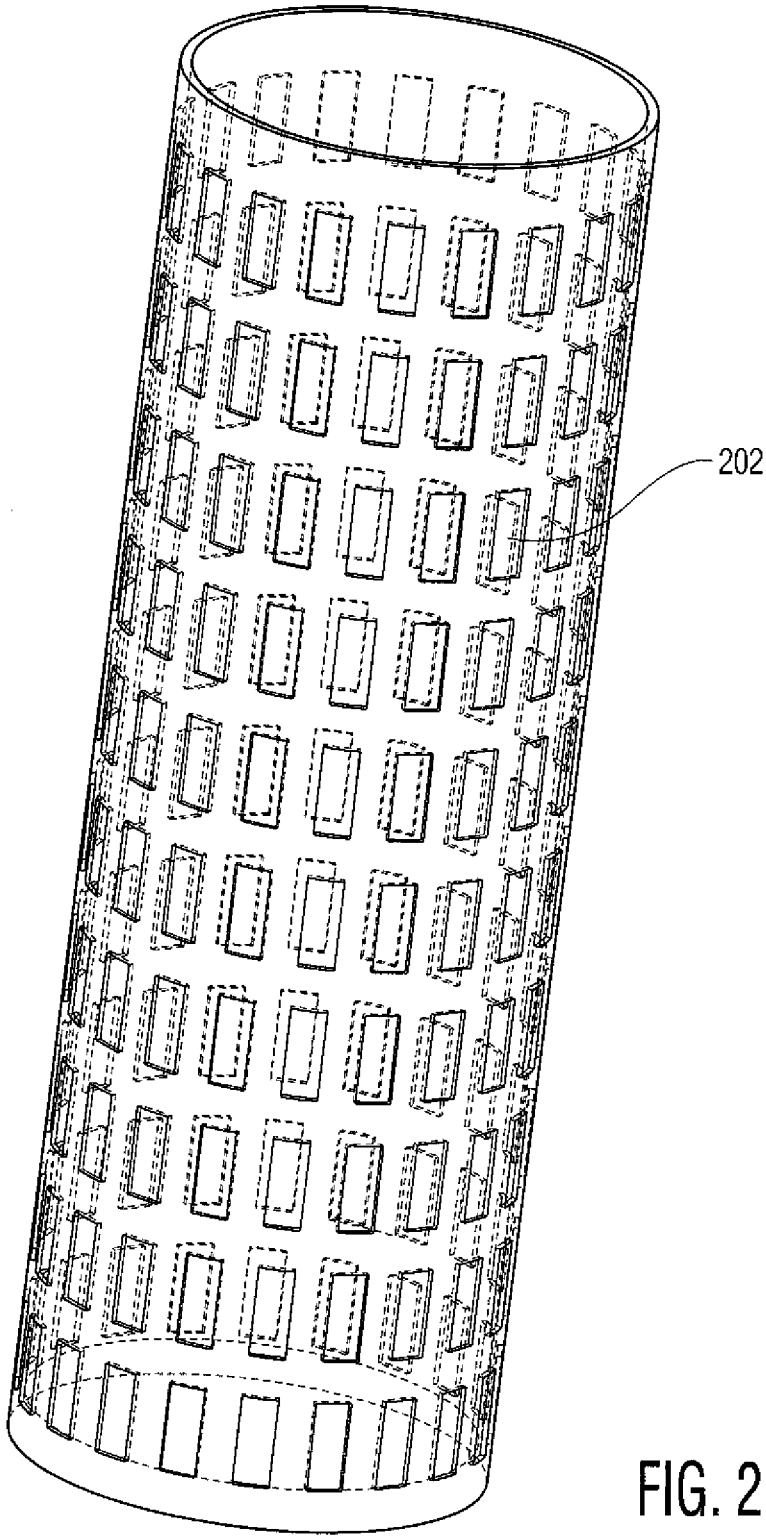
FIG. 2 shows an isometric view of inner liner 200 according to the invention with a grid system of recessed areas 202, that is internal to the fragmenting warhead of FIG. 1.
Figure 3:
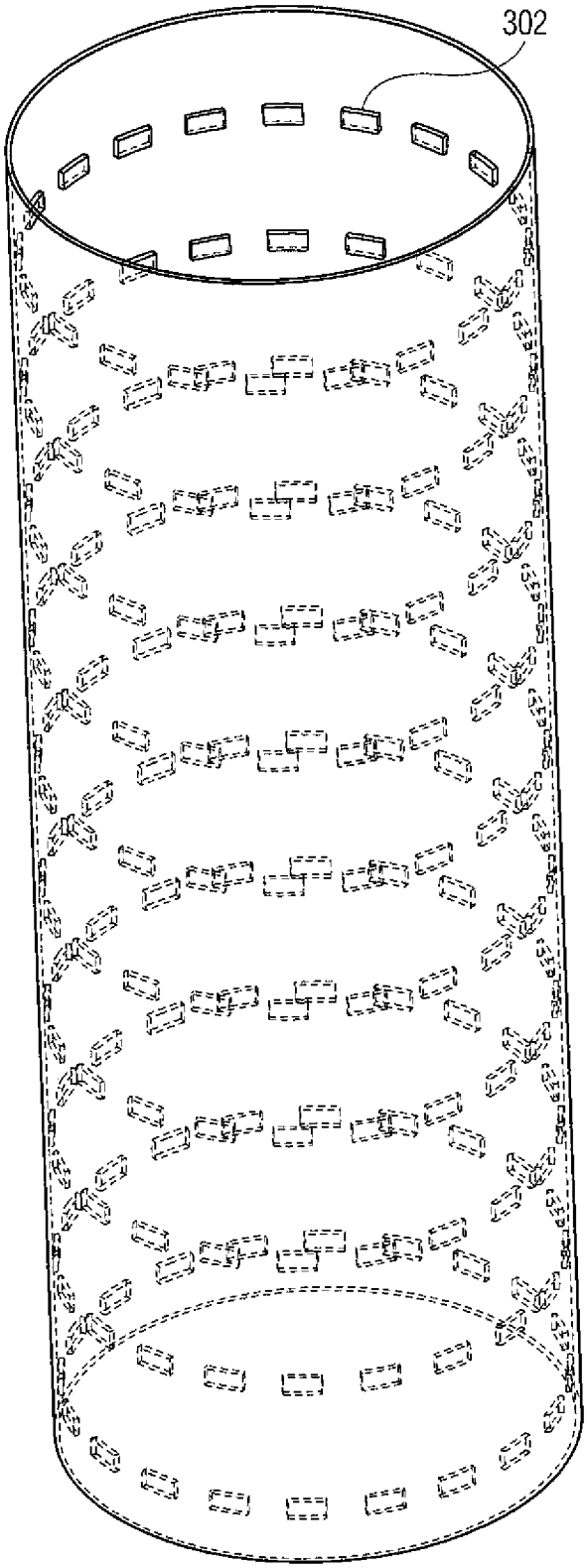
FIG. 3 shows an isometric view, inside of the fragmenting warhead, of an outer sleeve liner 300 (with its inner surface grid system of raised tabs 302), that is sized to fit in tight assembly to grip (around) liner 200 of FIG. 2.

FIG. 1 illustrates an exemplary warhead, projectile, munition, explosively formed projectile, or shaped charge liner, etc., (referenced herein as warhead 100), utilizing liners 200 and 300 that are selectively patterned to effect control of fragmentation of a warhead body 102 according to the present invention. The warhead 100 generally comprises the fragmenting warhead body 102 that houses the liners, an explosive or explosive charge 104, back plates (not shown), and an initiation mechanism assembly (not shown). The warhead liners generally take the cylindrical shape of the warhead body 102. The explosive charge 104 comprises, for example, LX-14, OCTOL, hand packed C-4, or any other solid explosive, that can be machined, cast, or hand-packed to fit snugly within the inside of inner liner 200. As further illustrated in FIG. 2, 3, and in more detail hereunder, a pattern of the liner 200 has recessed areas 202 while the outer liner 300 has rectangular tabs 302 meant to fit therein and be able to be slid up and down there within. In the embodiment shown, the layout of the tabs and recessed areas are all symmetrical and equidistant, in the sense that the position of each tab within its respective recessed area is the same for all tabs, i.e., if one tab is midway inside a recessed area, all tabs will be so positioned within their respective recessed areas. If one tab were at the end inside a recessed area, then all tabs will be likewise so positioned within their respective recessed areas, e.g. However, it is possible to vary the size, the shape, and the positioning of the tabs and recessed areas so they are not all identical, symmetrical, equidistant, or even of the same geometric shapes, thicknesses or depths, wherever advantages could be realized thereby. The recessed areas could be formed by a conventional method such as stamping or stereo lithography. The liners could be made of any suitable low-melt temperature material such as HDPE (High Density Poly Ethylene), or Accura SI 40 stereo lithographic material mimicking Nylon 6:6. Liner thickness could be approximately a fraction of a millimeter to several millimeters. It will be appreciated that the liners are made of a low melt-temperature plastic material to facilitate heat-induced melt out, further enhancing ammunition resistance to fire hazards wherein, in the event of unwanted heat or pressures of launch, the liner plastic melts and flows acting to seal the explosive from catastrophic fratricide, and further the melted plastic also tends to flow to exit the warhead to eliminate pressure within the body. While plastic has been described as a liner material, numerous other materials might be used such as steel, copper, tungsten, aluminum or titanium, e.g., which might be employed based on actual warhead application and type of explosive fill. Upon detonation of the explosive charge 104 of the warhead 100, in the areas of liner recessed areas 202 that are not blocked by tabs 302, the momentum of the shock wave propagating through the explosive 104 is transmitted more readily to analogous sections of the interior of the warhead body 102 by breaking through, as compared to breaking through the thicker areas that are blocked by a tab 302, and then to those analogous sections of the interior of the warhead body 102.

The time delay between the moments when the shock waves arrive is determined by the differences between the detonation velocity of the explosive 104 and the shock wave propagation speed of liner material, in various thicknesses of the liner material, respectively. It can be appreciated that this generates a high gradient of pressures, velocities, and strains between parts of the liners, acting as stress and strain "concentration factors". Unstable thermoplastic shear (adiabatic shear) eventually transfers the entire burden of localized strain to a finite number of shear planes leading to the warhead body 102 break-up and formation of fragments. As a result, a predetermined pattern of liner recessed areas or tabs can "stamp out" a pattern of localized transitional regions so as to cause the warhead body 102 to shear and break into fragments, accordingly, with controlled sizes. The thinnest liner material presented to the explosion would be a recessed area 202 alone. As an example, twice as much material in thickness would be seen in an explosion, where a tab 302 fills part of that recessed area.

The thickness of a liner in various locations and type of explosive help determine the fragment results. A selectively controlled pattern of recessed areas can comprise sections of equal size or, alternatively, sections ranging in size from a relatively large size to smaller sections. The larger size of such sections is selected for more heavily armored targets, while the smaller size of such sections is applicable for lightly armored or soft targets. Consequently, the pattern efficiently enables variable and selective lethality of the warhead 100 that can range from maximum lethality for more heavily armored targets to a maximum lethality for lightly armored or soft targets.

Figure 4A:
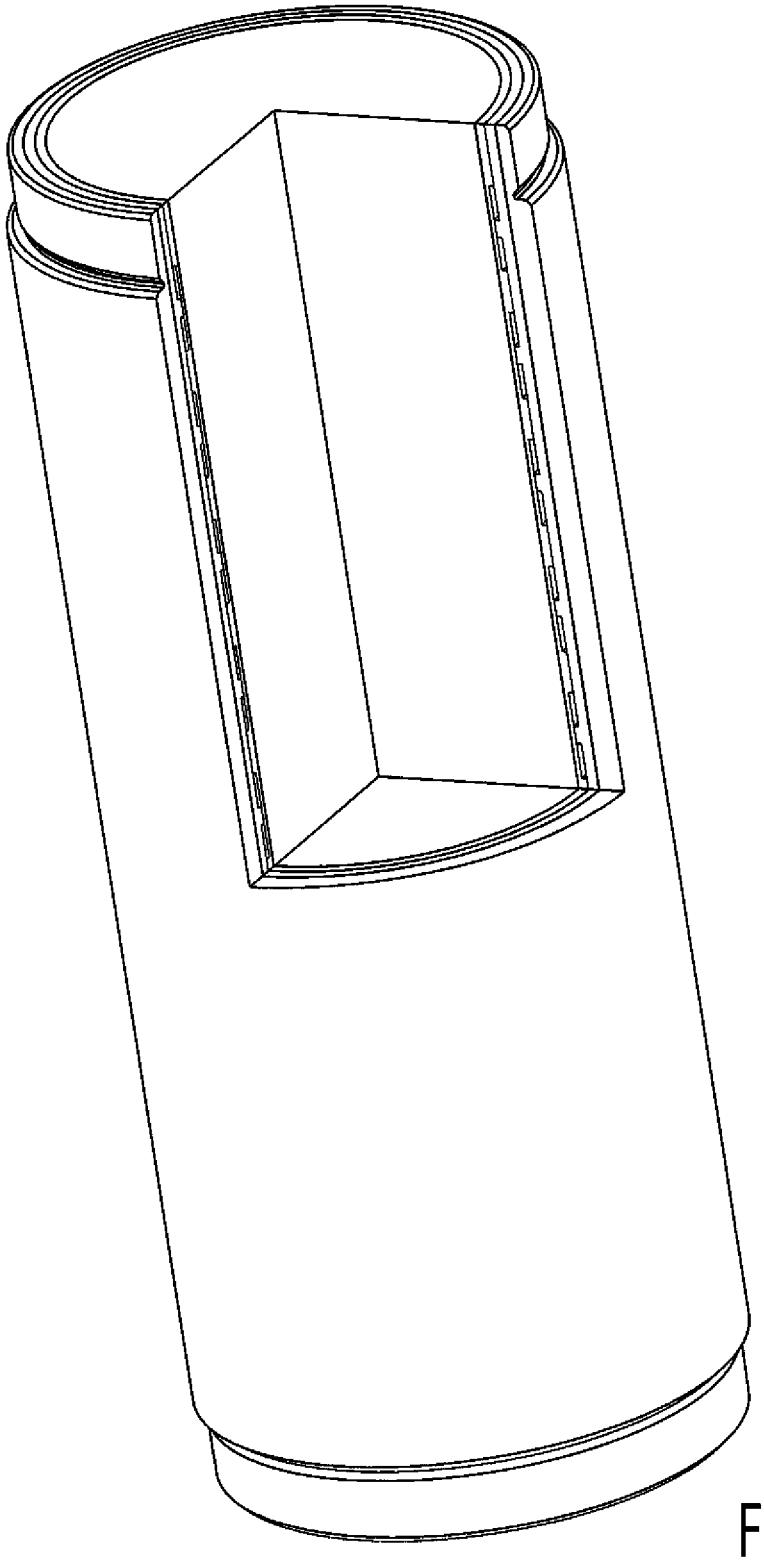
FIG. 4A shows positioning of the sleeves of FIG. 1 to favor development of large fragmentation.
Figure 4B:
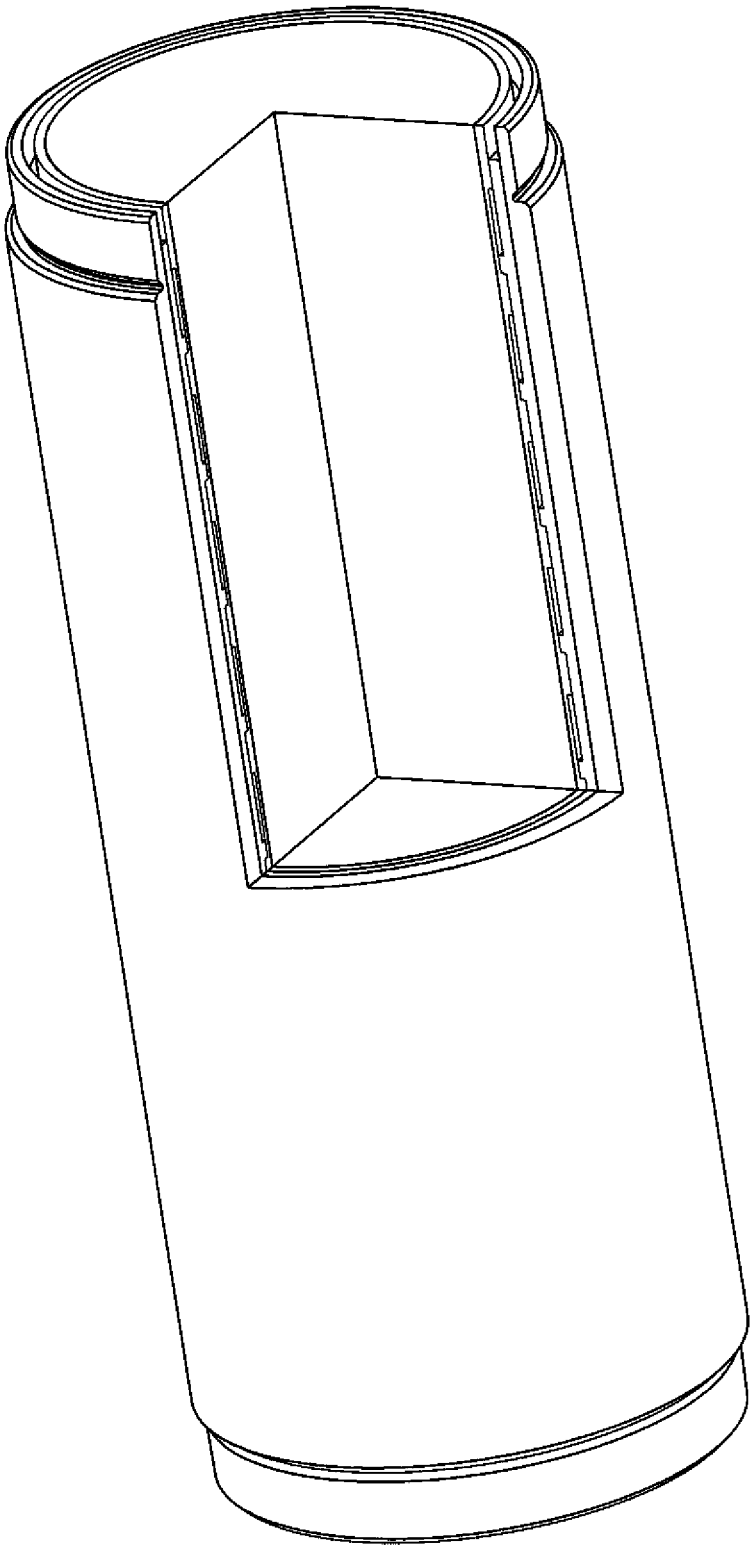
FIG. 4B shows positioning of the sleeves to favor development of smaller size fragmentation.

Mechanical adjustments to the grids could be translational (in or out) or rotational (but rotational only if the tab 302 widths were made less than the recessed area 202 widths). As will be further described, all these movements will have an ultimate influence on sizes for the fragments to be formed on the exploding fragmenting warhead housing 102. FIG. 4A shows positioning of the sleeves to favor development of large fragmentation. Here, the tabs 302 are positioned roughly in the middle of the recess areas 202 (which situation is illustrated by FIG. 7B where tab 720 there is roughly in the middle area of a recess area 700 there). FIG. 4B shows positioning of the sleeves to favor development of smaller size fragmentation. Here, the tabs 302 are positioned roughly at one far end of the recess areas 202 (which situation is illustrated by FIG. 7C where a tab 720 there is roughly at one far end of a recess area 700 there).

Figure 5:
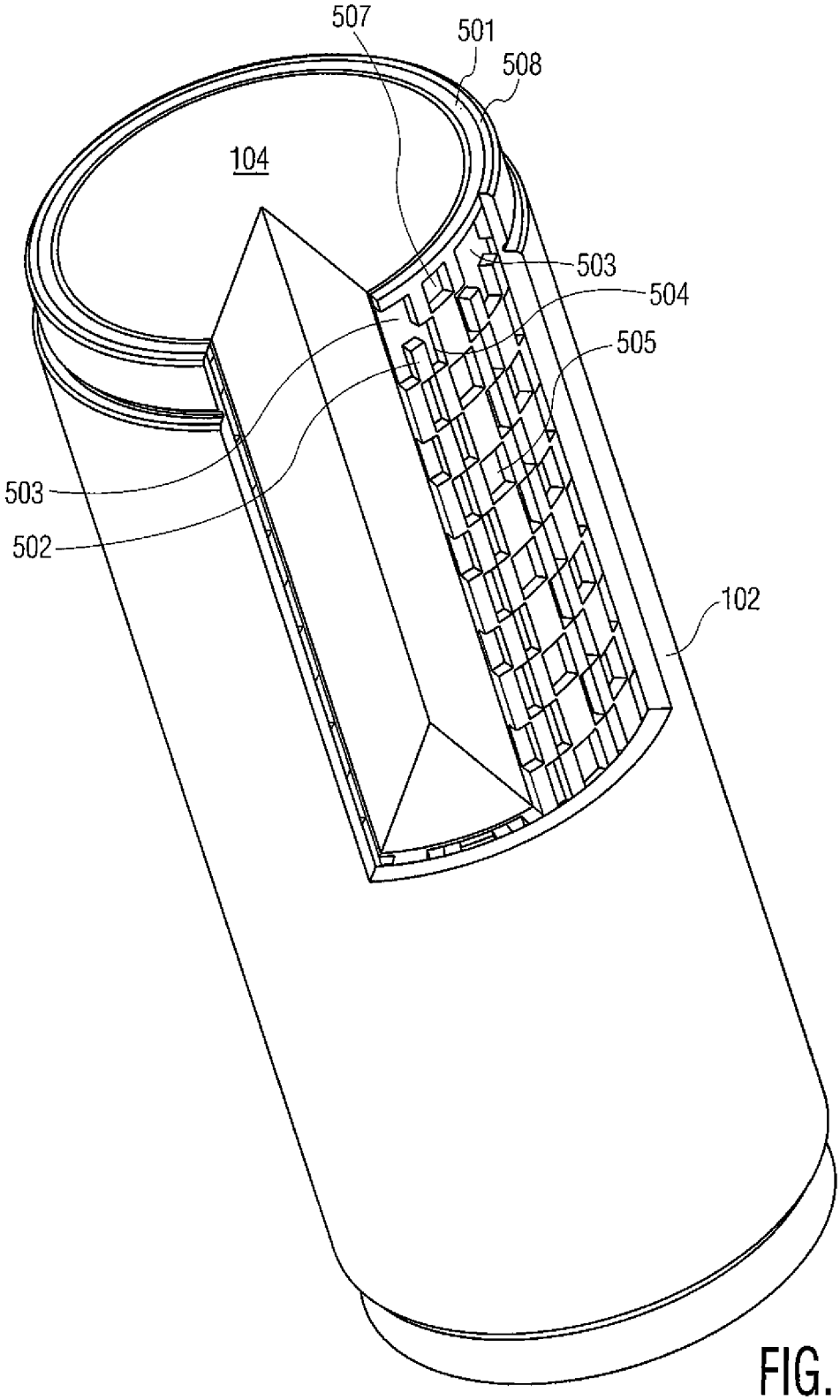
FIG. 5 shows an embodiment having sleeve liners different from FIG. 1 and positioning of these (different type) sleeve liners to favor development of smaller size fragmentation.
Figure 6:
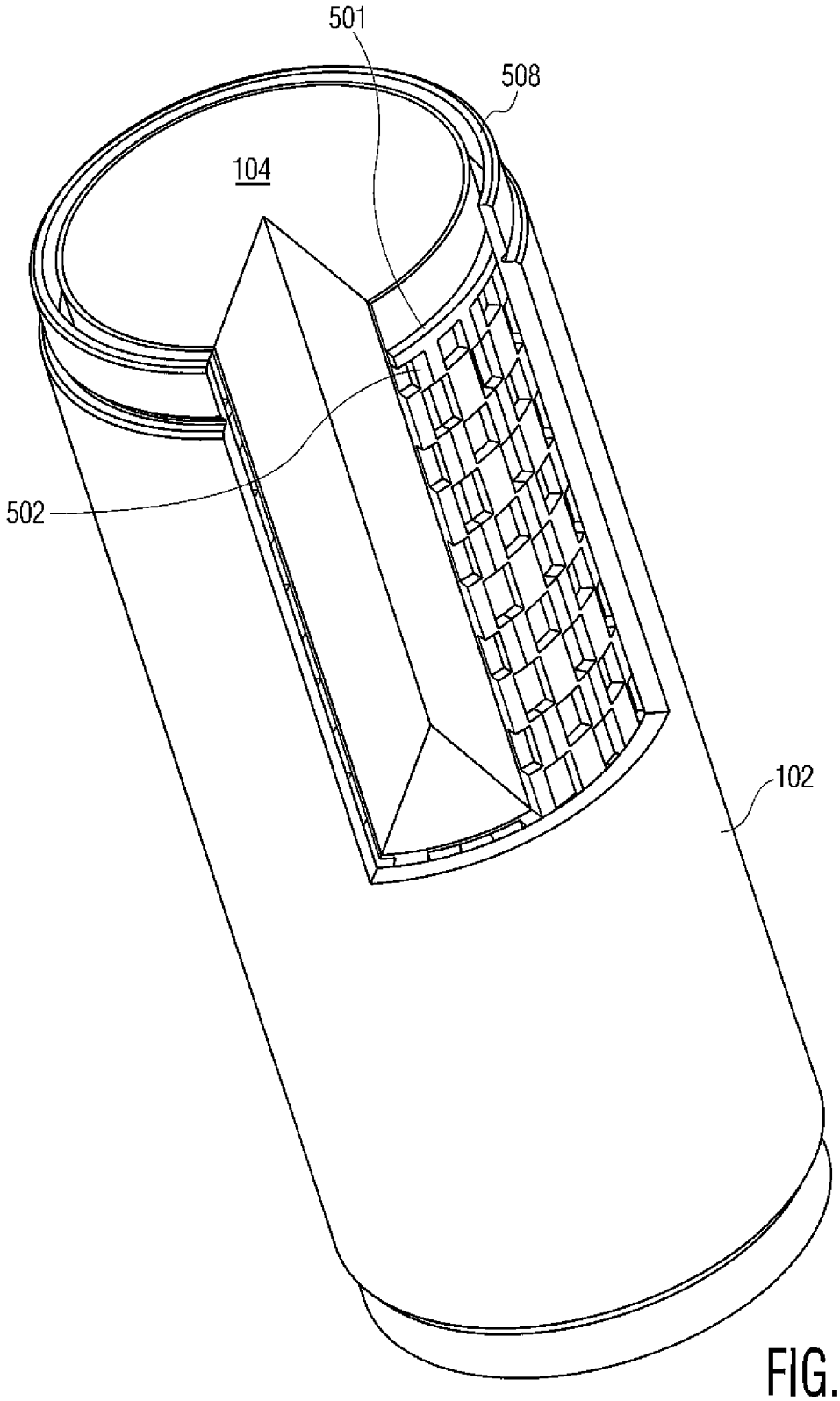
FIG. 6 shows an embodiment having sleeve liners different from FIG. 1, and positioning of these (different type) sleeve liners to favor development of larger size fragmentation.
Figure 6A:
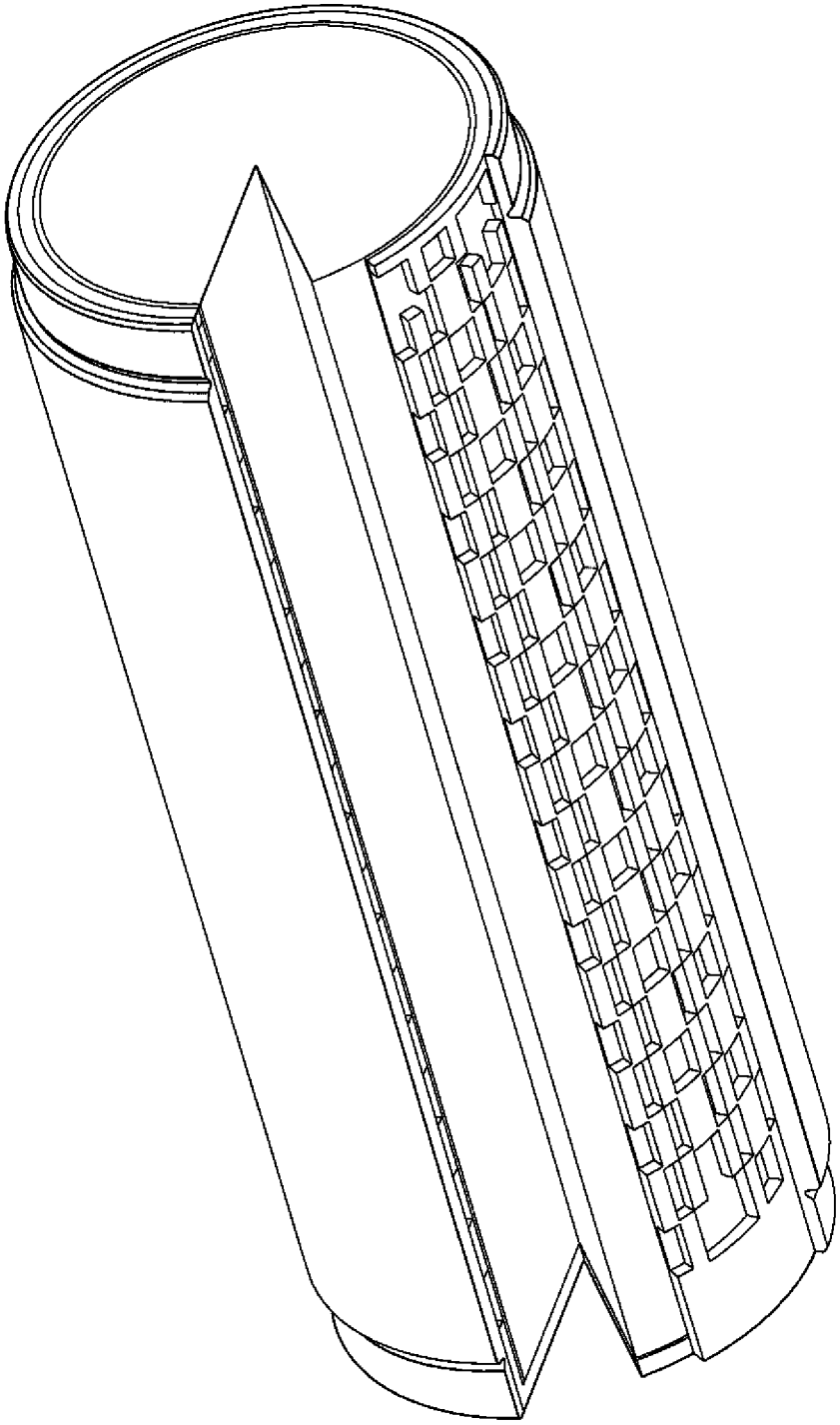
FIG. 6A illustrates in shaded form the positioning shown in the FIG. 6 sleeves embodiment, to favor development of larger size fragmentation.
Figure 6B:
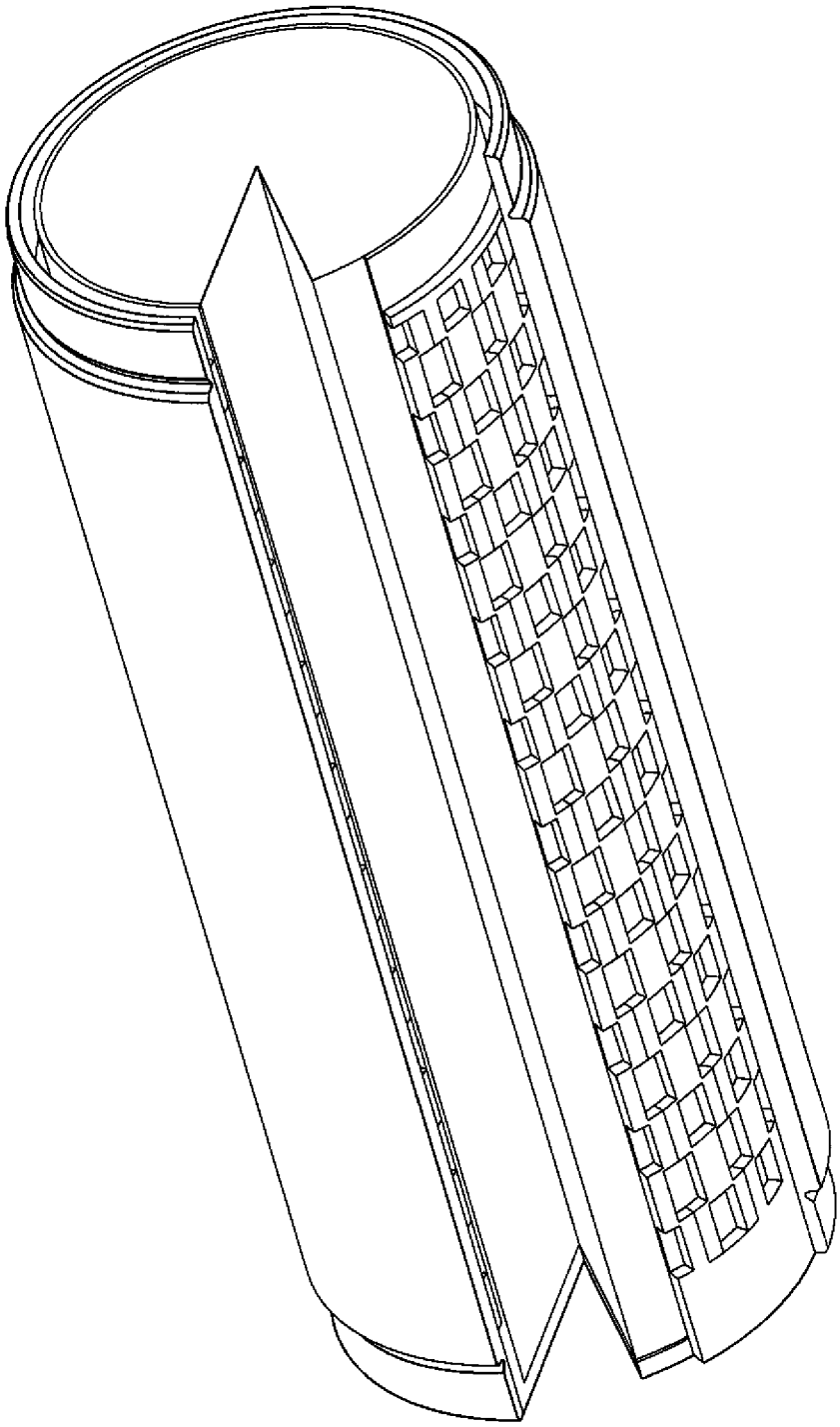
FIG. 6B illustrates in shaded form the positioning shown in the FIG. 5 sleeves embodiment that favors development of smaller size fragmentation and FIG. 6C shows another embodiment of a sleeve system 693, 694, 695 having tabs 696 and slots 697, wherein the sections are shown arranged in one possible layout that will favor development of smaller sized fragmentation.
Figure 6C:
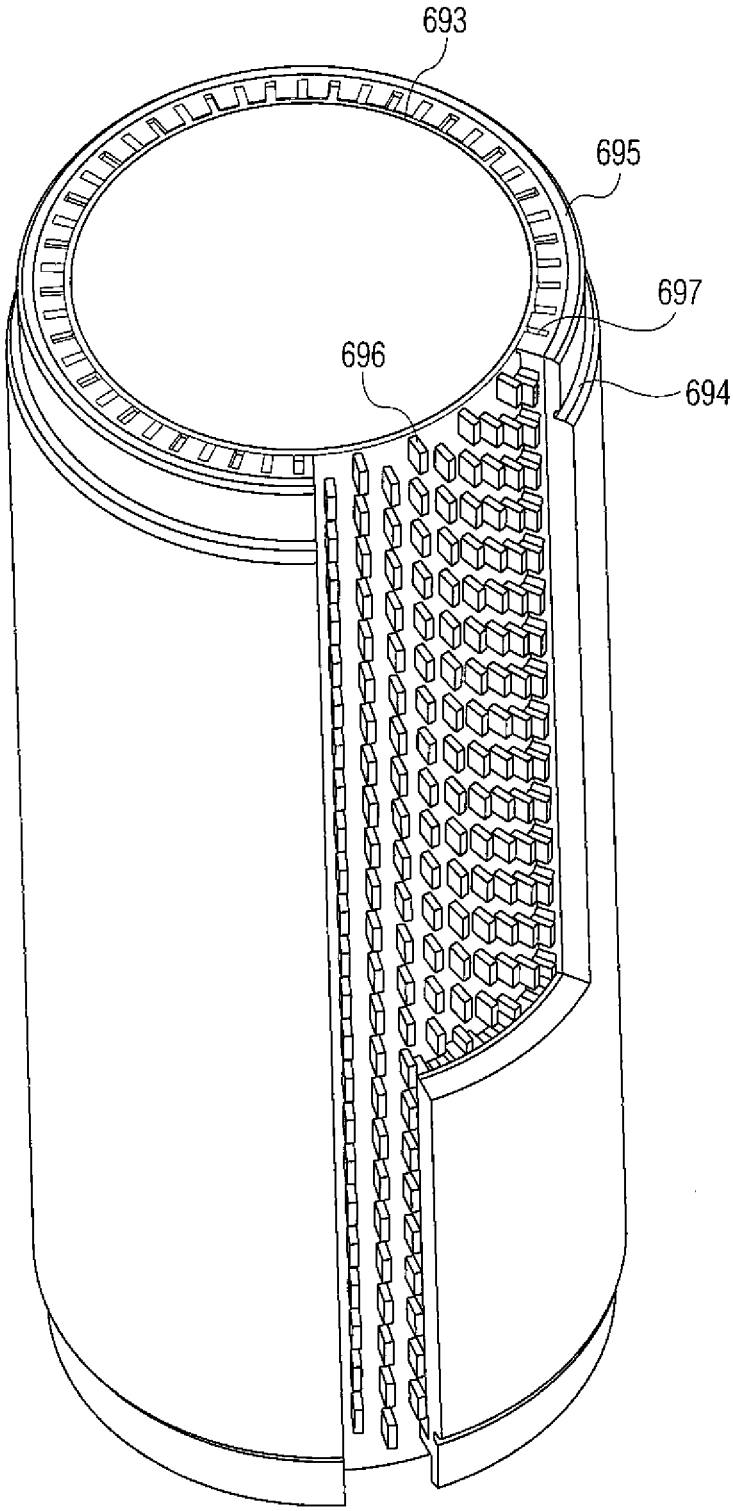

FIG. 5 shows positioning of different types of sleeve liners to favor development of smaller size fragmentation, while FIG. 6 shows positioning of these other type sleeves to favor development of large size fragmentation. Outer liner 508 has a lattice like inside structure of many legs 502 interspersed with open spaces 504 and boxed recessed areas 505. Tightly fitting inner liner 501 has openings such as 503 which accommodate legs 502 sliding there into when the sleeves are so moved, and also has boxed in recessed areas 507. By closing the sleeves as shown in FIG. 6, a more tight joined structure is created, with maximum of open areas that favor development of large size fragmentation. While the sleeves are pulled apart as in FIG. 5, it is more likely that smaller fragments can be formed, this because there are fewer contiguous open areas seen by a detonation. The sleeves can also be rotated to advantage, in helping to form a minimum/maximum of open areas, to aid in forming smaller sized vs. larger sized fragments. Shaded in FIG. 6A structure for large fragment formation and shaded in FIG. 6B structure for smaller fragment formation, show this effect somewhat more vividly. The FIGS. 7A-7C and 8A-8B and accompanying explanation, will help to explain why the (tab 302+recess 202) physical structure in FIGS. 1A-4B and the leg (502+opening 503) physical structures in FIGS. 5-6B can be moved about to influence development of smaller sized vs. larger sized fragments.

Figure 7A:
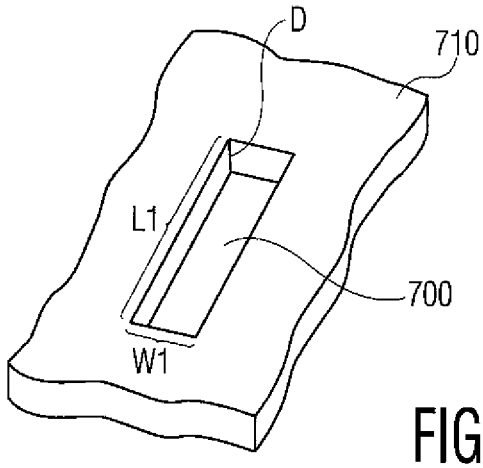
FIGS. 7A-7C and FIGS. 8A-8B attempt to show conceptually how the physical structures in FIGS. 1-3, 4A-4B, 5-6, and 6A-6C can be variously moved about to influence development of smaller sized vs. larger sized fragments.
Figure 7B:
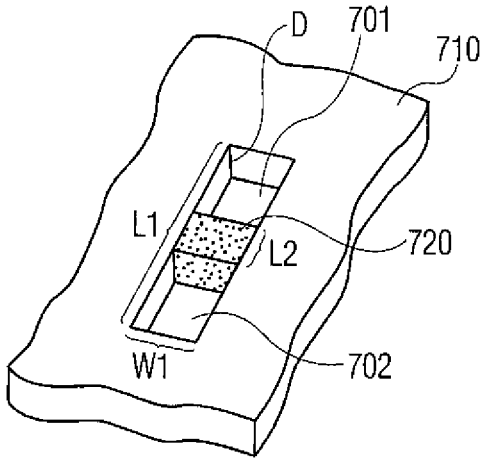
Figure 7C:
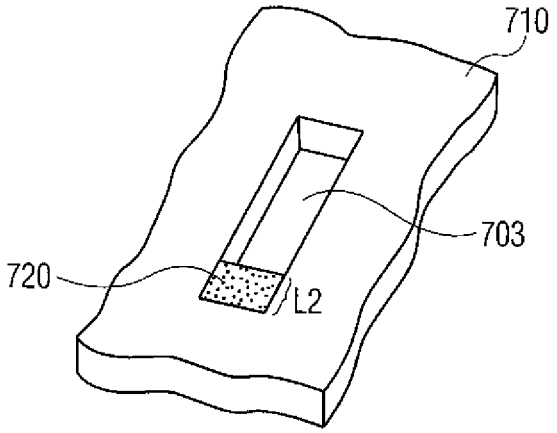
Figure 8A:
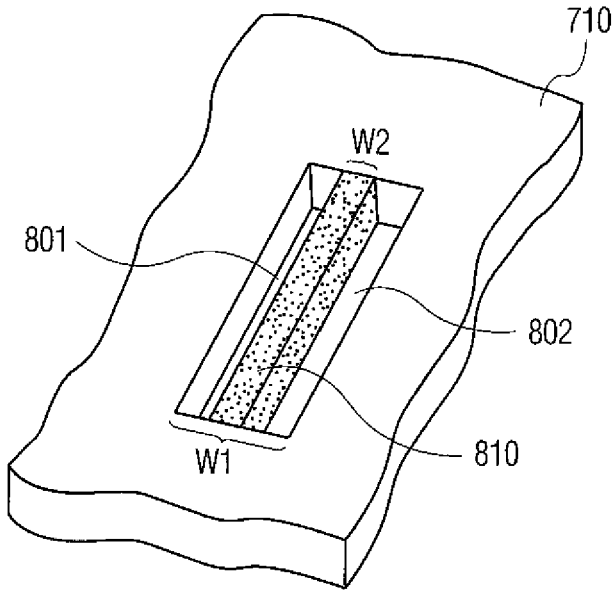
Figure 8B:
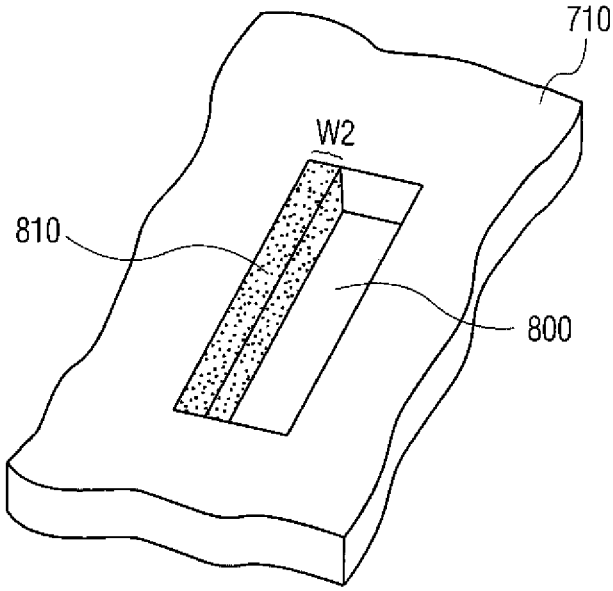

FIG. 7A shows a recessed area 700 in a general plane area 710. Recessed area 700 has a depth of D, a length of L1, and a width of W1. FIG. 7B shows the same recessed area 700 of length L1, however it is now blocked in the central area by a solid tab 720, which tab has a (relatively short) length of L2, otherwise with the same depth of D, and same width of W1. The presence of tab 720 divides the recess into two smaller recessed areas 701 and 702. To note, the FIG. 7A relatively long (L1) contiguous area is more likely to lead to a larger size fragment, than either of the two smaller recessed areas 701 and 702. In FIG. 7C, the tab 720 has been positioned so that it is at one of the extreme ends of recess 700, leaving an almost as large recessed area 703 (whereas a length of only L2 of recessed area 700 has been blocked off by the tab). The FIG. 7C relatively long contiguous area is likely to lead to a large size fragment, almost as large as the FIG. 7A recess. The part of 700 blocked off by the tab is relatively negligible as far as forming a larger sized fragment is concerned. In FIG. 8A, in an identical sized recessed area as was 700 in FIG. 7B, a leg 810 now is placed midway in the recessed area to block it in that area. Leg 810 has a width W2 which is perhaps one third of full width W1 of the full recessed area 700. The recessed area has now been reduced to two smaller recessed areas, 801 and 802. Recessed areas 801 and 802 are likely to only lead to two smaller sized fragments, than the full recessed area 700 which relatively wide and long contiguous area is likely to lead to a larger sized fragment. In FIG. 8B, leg 810 is placed instead over to one side of the recessed area 700, leaving a less wide (W1-W2) recessed area 800. Recessed area 800 will still lead to a larger sized fragment because of the still relatively wide contiguous open area of 800, that is larger than the recessed areas of 801, 802. While the recessed areas and tabs discussed herein have been rectangular in shape, numerous other shapes are possible, such as diamond shape, semi-circular, or triangular shaped, e.g.

While the invention has been described with reference to certain embodiments, numerous changes, alterations and modifications to the described embodiments are possible without departing from the spirit and scope of the invention as defined in the appended claims, and equivalents thereof.

What is claimed is:

1. A warhead with controlled fragmentation, comprising an outer, hollow cylindrically shaped, fragmentation warhead body; said warhead further comprising:

a concentric first cylindrical liner formed in a predetermined pattern;

a cylindrical explosive charge that is disposed within an interior surface of, and completely fills the space of, said first cylindrical liner;

a concentric second cylindrical liner that is formed in a predetermined pattern, which second cylindrical liner is of a greater diameter to and which is positioned to snugly surround said first cylindrical liner but wherein said first and second cylindrical liners may be translated or rotated relative to one another, and;

said second cylindrical liner provides various legs of raised liner material and said first cylindrical liner provides corresponding various open receptacle areas, into which such legs may come to rest when the liners are slid together relative to one another, and whereby such translation of the cylindrical liners, or rotation of the cylindrical liners after such translation, affords the formation of random areas of raised, versus recessed, areas of combined liner material, and;

wherein upon detonation of the explosive charge, detonation energy propagating through thinner areas of combined liner material are transferred more readily to the interior of the said warhead body, but the detonation energy propagating to the interior of the said warhead body after striking through thicker areas of combined liner material are more dampened; and wherein such differences between these transferences to the interior of the warhead body cause the warhead body to shear and break into different sized fragments.

2. The warhead of claim 1, wherein the second cylindrical liner is stationary.

* * * * *